US005605191A

United States Patent [19]

Eto et al.

[11] Patent Number: 5,605,191

[45] Date of Patent: Feb. 25, 1997

[54] HEAT EXCHANGER

[75] Inventors: Yoshihisa Eto; Toshio Tsubakida; Takashi Sugita, all of Konan, Japan

[73] Assignee: Zexel Corporation, Tokyo, Japan

[21] Appl. No.: 589,006

[22] Filed: Jan. 19, 1996

[30] Foreign Application Priority Data

Jan. 19, 1995 [JP] Japan ..... 7-024708
Nov. 21, 1995 [JP] Japan ..... 7-325235

[51] Int. Cl.[6] ..... F28D 7/06

[52] U.S. Cl. ..... 165/176; 165/173; 165/79; 165/76; 165/153; 228/257

[58] Field of Search ..... 165/176, 173, 165/79, 76, 153, 174; 228/256, 257, 285

[56] References Cited

U.S. PATENT DOCUMENTS 2,184,658 12/1939 Young ..... 165/79
5,479,985 1/1996 Yamamoto et al. ..... 165/176
5,492,172 2/1996 Laveran et al. ..... 165/173

*Primary Examiner*—John Rivell
*Assistant Examiner*—Christopher Atkinson
*Attorney, Agent, or Firm*—Wenderoth, Lind & Ponack

[57] ABSTRACT

An end plate of a tank whose inside is partitioned by a partition has a plurality of insertion holes receiving connecting portions of tube elements. In the end plate, a first projection is distended and formed so as to run through narrow middle portions of the insertion holes, and a fit groove for the partition is formed on the inside of the first projection. Even when a core of the heat exchanger is put sideways on a furnace in a heat brazing method, brazing filler material can easily flow into the gaps between the insertion holes and the tube elements inserted into the insertion holes. As a result, good brazing can be performed.

12 Claims, 9 Drawing Sheets

HEAT EXCHANGER

BACKGROUND OF THE INVENTION

1. Field of the invention

The present invention relates to a heat exchanger used in an air conditioning apparatus for an automobile, for instance, especially one that is constituted by a tank and tube elements assembled separately during assembly of the heat exchanger.

2. Description of the related art

A heat exchanger shown in FIGS. 10 and 11 is constituted by a tank and tube elements that are formed separately.

In the heat exchanger 1, a tank 10 comprises an end plate 12 and a tank member 13 in which a space is formed, the space being partitioned by a partition 11. Insertion holes 14 are formed in the end plate 12, and the tube elements 2 are inserted into the insertion holes 14. Each tube element 2 has an inner passage which is formed in a U-shape by a partitioning wall 2*c*, and intake/output openings 6, 6 are formed in a connecting portion 5 that is inserted into the insertion holes 14.

The heat exchanger 1 is constructed by a core of the heat exchanger being made by placing fins 3 between the tube elements 2 and inserting the connecting portion 5 of the tube elements 2 into the insertion holes 14, and then brazing the core in a furnace.

However, when the heat exchanger is brazed by the so-called heat brazing method, which is also called NB method, a method in which a non-corrode flux is applied to the core and then brazed in the furnace, because the furnace 30 used in the heat brazing method is low, as shown in FIG. 11, the core of the heat exchanger needs to lay sideways to be put into the furnace 30. In this case, because the elongate direction of the insertion holes 14 in which the tube elements 2 are inserted is perpendicular to the horizontal, a brazing filler material of the surface of the end plate 12 flows along the edge of the insertion hole 14 in the perpendicularly downward direction by the gravity. Furthermore, because it is difficult to perfectly form the insertion holes 14 of the end plate 12 along the periphery of the connecting portion 5 of the tube elements 2, gaps A may be easily formed between the insertion holes 14 and the tube element 2 easily as shown in FIG. 12.

Thus, when the brazing filler material flows along the periphery of the insertion holes 14 in the downward direction, the gaps A between the insertion holes 14, especially at the upper portion of the insertion holes 14 and the connecting portion 5 of the tube elements 2, may easily lack brazing filler material. Lacking the brazing filler material causes poor bonding between the tank 10 and tube elements 2 and the problem that a heat exchanging medium can leak out from the portion lacking brazing filler material.

SUMMARY OF THE INVENTION

Accordingly, the object of the present invention is to provide a heat exchanger having a structure where brazing between an insertion hole and a connecting portion of a tube element can be good in case where a core of the heat exchanger lays sideways in a furnace during a heat brazing method.

Therefore, a heat exchanger of the present invention comprises a tank partitioned with an intake side and an output side by a partition extending in a direction of lamination and tube elements inserted into insertion holes formed on a end plate of the tank. The tube elements connect the intake side and the output side of the tank with each other and are laminated in the direction of lamination with fins therebetween. First projections, having grooves for partitioning plate therein, and second projections positioned respectively side by side between the insertion holes and perpendicularly to the first projection, are formed on the surface of the end plate.

The second projections may be formed to cross the first projection perpendicularly, or formed separate from the first projection.

Accordingly, in case the heat exchanger lies sideways when being brazed in a furnace, the brazing filler material is prevented from flowing downward by the first and second projection. Thus it is easy for the brazing filler material to flow between the insertion holes and the connecting portions. In other words, the brazing filler material flows to the sides of insertion holes form the second projection formed on the surface of the end plate of the tank, and a part of the brazing filler material is dammed by the first projection and flows to the sides of the insertion holes along the first projection.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings, which illustrate preferred embodiments. In the drawings.

DETAILED DESCRIPTION OF THE PREFERRED EMBODIMENTS

Figure 1:
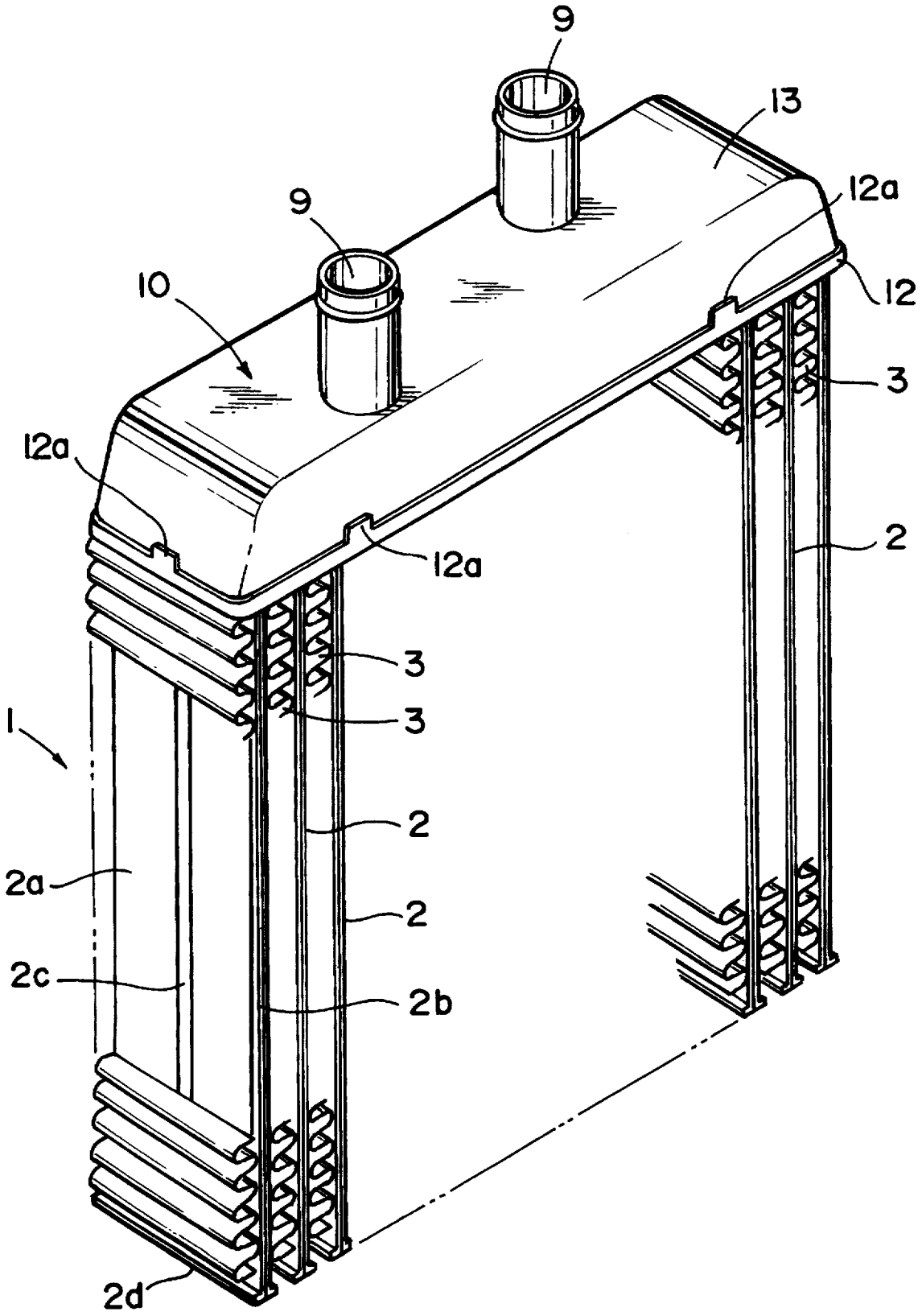
FIG. 1 is an illustration which shows a whole structure of a heat exchanger according to a form of the invention.

The following is an explanation of the embodiments according to the present invention with reference to the drawings.

A heat exchanger 1 illustrated in FIGS. 1 through 6 is used as a heater core, for instance in an air conditioning system for an automobile. The heat exchanger 1 is fundamentally constituted by laminating tube elements 2 and corrugated fins 3 alternately over a plurality of levels, and connecting one end of the tube elements 2 to the tank 10 having intake/output pipes 9,9.

The tube element 2 is approximately rectangular, and is constructed by bonding flush a pair of formed plates formed of an aluminum alloy whose main ingredient is aluminum.

Every tube element 2 is provided with a heat exchanging medium passage 2*a* which is formed like U-shape by a partitioning wall 2*c* extending in the middle of the tube element 2 and a bonding edge 2*b* on the periphery thereof. A projecting plate 2*d* for preventing fins 3 from coming out extends in the direction of lamination on the lower portion of the tube element 2. A connecting portion 5 is inserted into an insertion hole 14 in upper portion of the tube element 2, with intake/output openings 6, 6 opening in the tank 10 being formed in the connecting portion 5.

Figure 3:
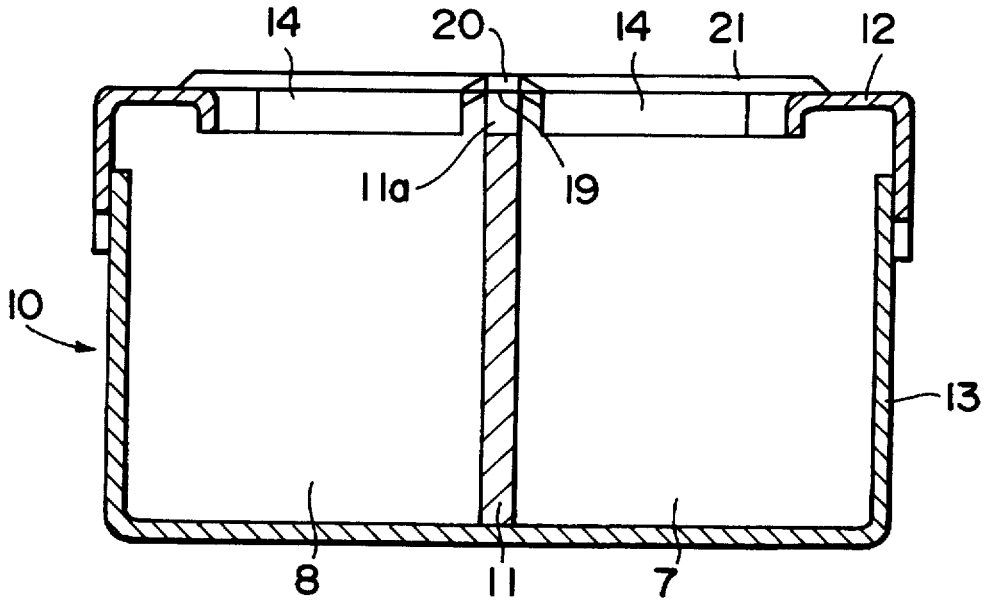
FIG. 3 is a cross-section view of the tank of the heat exchanger.

The tank 10 is, especially shown in FIGS. 1 and 3, constituted with an end plate 12, which is approximately rectangular and has a plurality of engaging projections or bits 12*a* standing on the periphery thereof, and an deeply concave tank member 13 engaging the end plate 12. The end plate 12 and the deeply concave tank member 13 are formed of an aluminum alloy whose main ingredient is aluminum, and the surfaces of the end plate 12 and the tank member 13 are claded with the brazing filler material.

Figure 5:
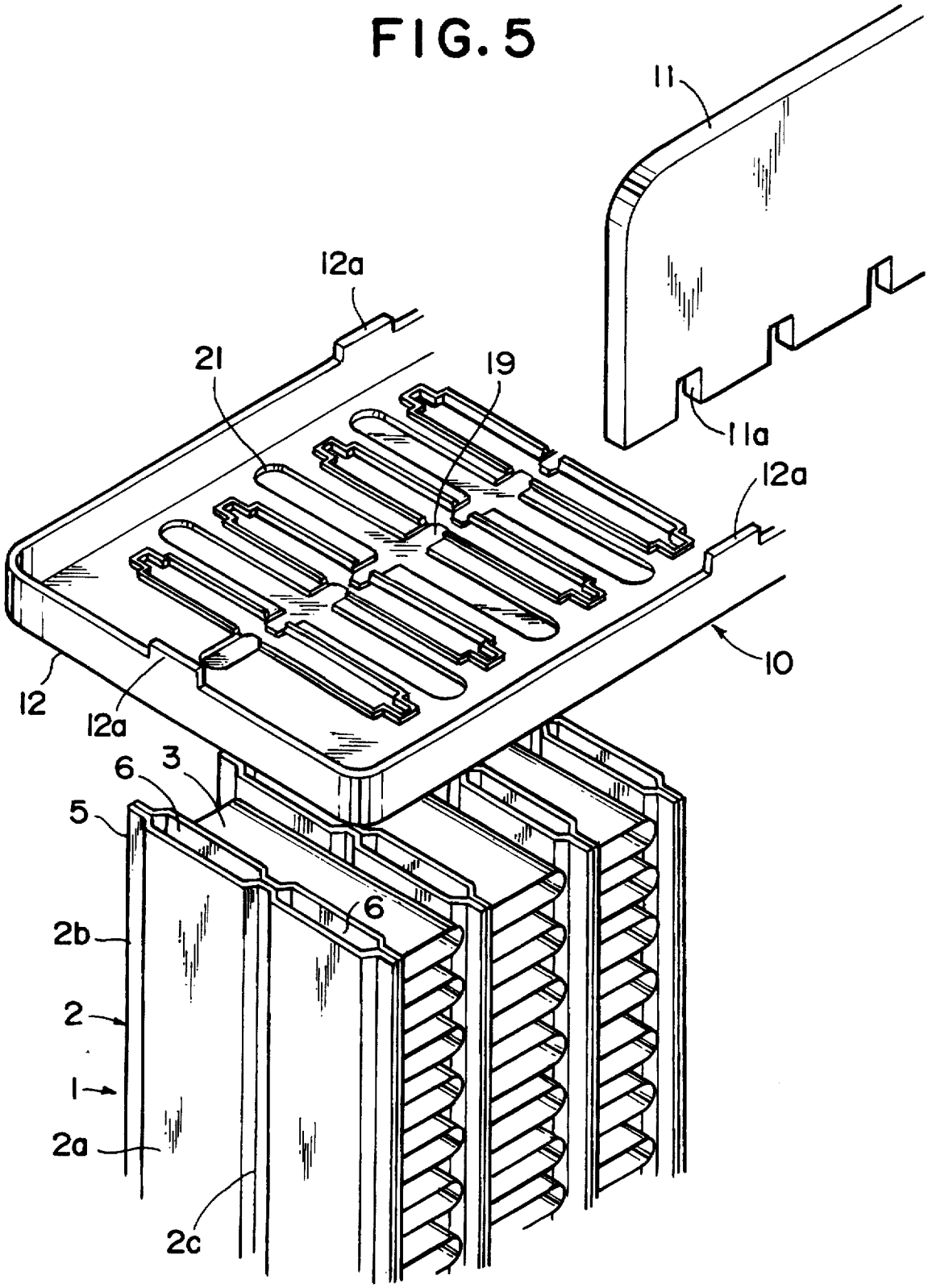
FIG. 5 is an illustration which shows a part of the assembly process of the heat exchanger.

An inner portion of the tank 10 is divided into two spaces, an intake side 7 and an output side 8 which are about equal to each other, by a partition 11 which is mounted along the direction of lamination of the tube elements 2. The intake side 7 and the output side 8 have intake/output pipes 9, 9, respectively. Furthermore, in the partition 11, as shown in FIG. 5, a plurality of vacant portion 11*a* are formed for engagement with the partitioning wall 2*c* of the tube elements 2.

A plurality of the insertion holes 14, into which the connecting portions 5 of the tube elements 2 insert, are formed in the direction of lamination. The insertion holes 14 are formed by a burring progress, which is to press so as to make burrs and remain them. As the periphery of the insertion hole 14 is in contact with the connecting portion 5 not linearly but squarely, the end plate 12 and the tube elements 2 may be surely brazed. The middle portion and both end portions of each insertion hole 14 are narrow to correspond to the shape of the tube elements 2.

The connecting portions 5 of the tube elements 2 insert into the insertion hole 14 so that the intake side 7 and the output side 8 of the tank 10 connect with each other through the heat exchanging medium passage 2*a* of the tube element 2.

Figure 2:
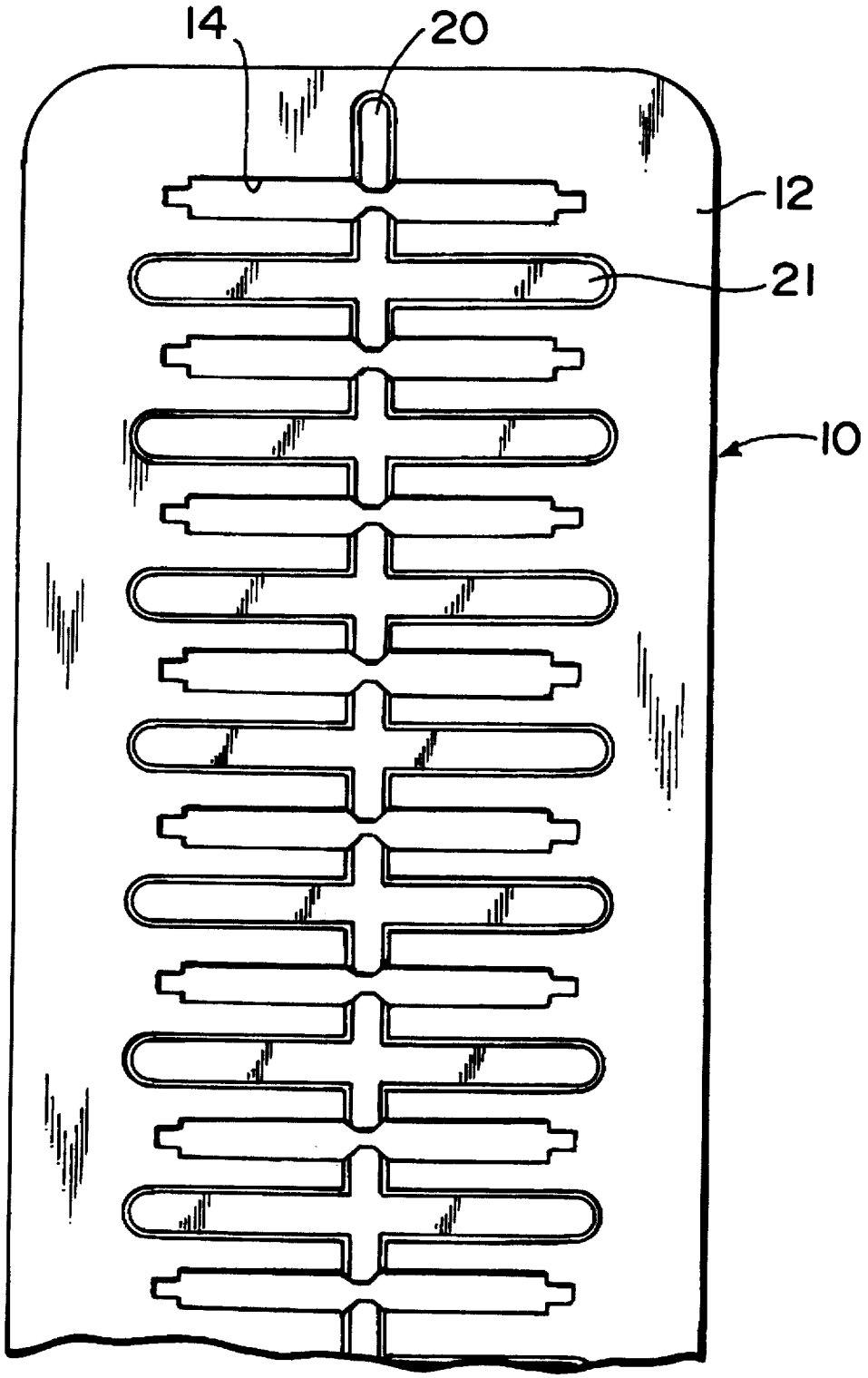
FIG. 2 is an illustration which shows a tank of the heat exchanger as seen from one side of an end plate.
Figure 4:
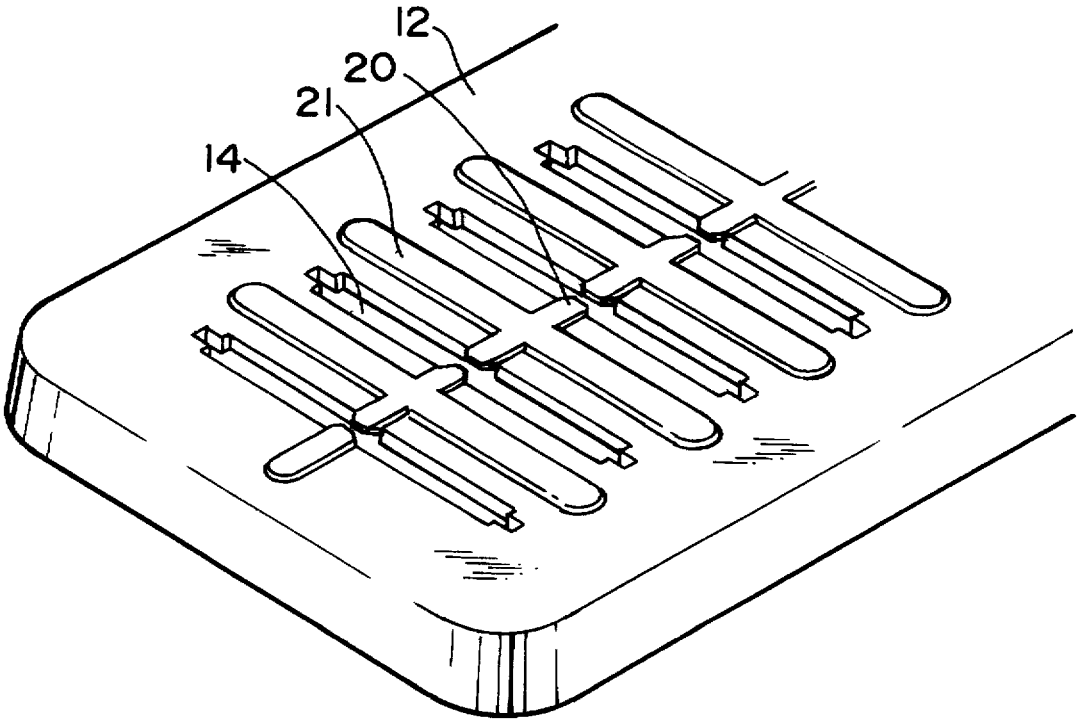
FIG. 4 is a perspective view of the end plate of the tank of the heat exchanger.

A first bead or projection 20 is formed in the direction of lamination on the surface of the end plate 12 as shown in FIGS. 2 and 4, passing through the middle portions, that is, the narrow portions, of the insertion holes 14. Thus, on the inside of the end plate 12, a fit groove 19 is formed on the inside of the first projection 20 as shown in FIG. 5, into which the partition 11 is fit. Consequently, assembly of the partition 11 can be improved, and leakage of the heat exchanging medium from the intake side 7 to the output side 8 or from the output side 8 to the intake side 7 is prevented. Furthermore, the first projection 20 is simultaneously formed with the fit groove 19 by a press, and then the insertion holes 14 are made, so that the fit groove 19, that is, the first projection 20, is divided into parts.

Furthermore, second beads or projections 21 are formed between the insertion holes 14 on the surface of the end plate 12 as shown in FIGS. 2 and 4. The second projections 21 cross the first projection 20 and longer than the insertion holes 14.

The first and second projections 20, 21 have a slope on the periphery thereof that makes it easy for the brazing filler material to flow. The amount that they are distended is set to be equal (about 0.5 mm).

An explanation about a process of assembly of the heat exchanger described above follows.

First, the first projection 20 and the second projections 21 are formed on the outside of the end plate 12 and the fit groove 19 is formed on the inside surface of the end plate 12 by the press at one time. Then the insertion holes 14 are formed, the partition 11 is fit into the fit groove 19 of the end plate 12, and the deep concave tank member 13 is engaged with the end plate 12.

The tube elements 2 are laminated by placing the fins therebetween over a plurality of levels. The connecting portions 5 of the tube elements 2 are inserted into the insertion holes 14 of the end plate 12, with the vacant portions 11*a* of the partition 11 being engaged with the partitioning wall 2*c* of the tube elements 2.

Figure 11:
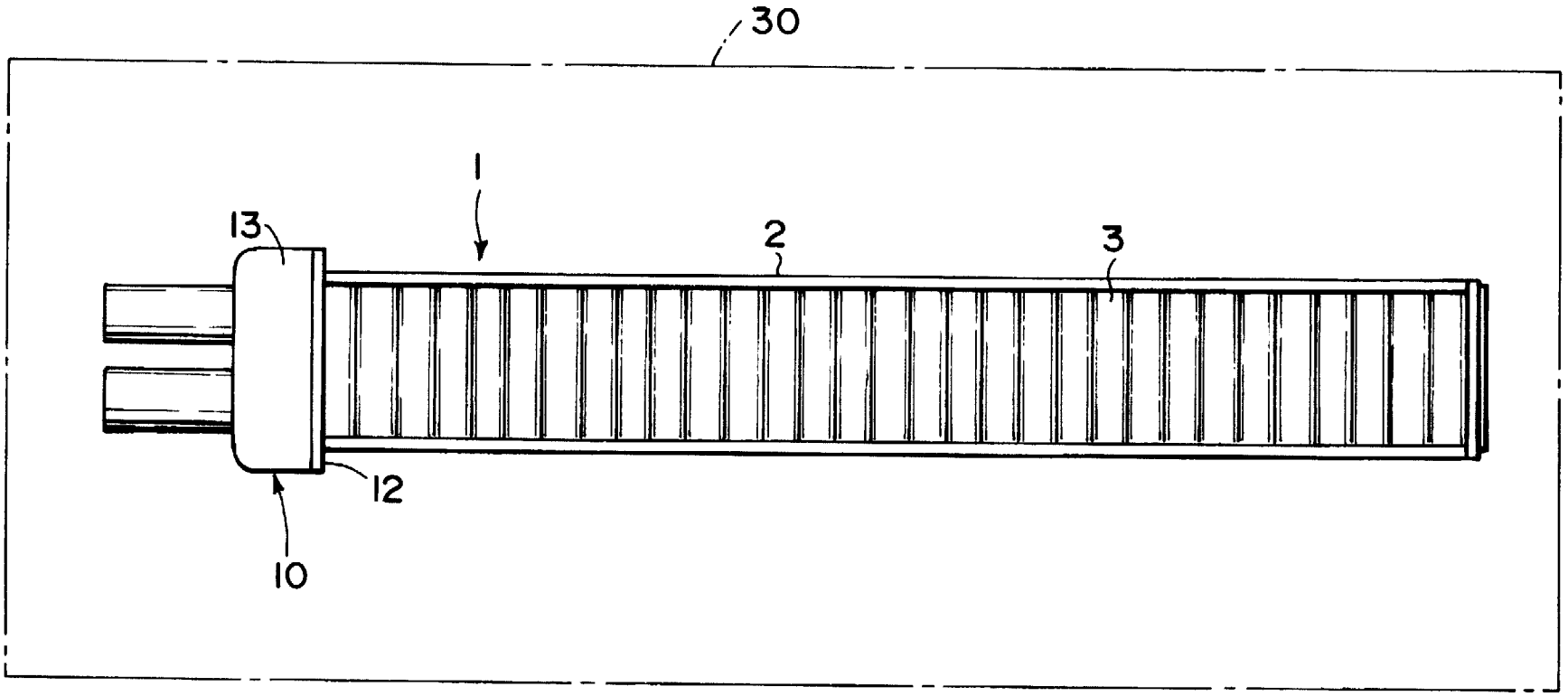
FIG. 11 PRIOR ART
FIG. 11 is an illustration which shows the state in which the heat exchanger of FIG. 10 is put into a furnace for brazing.
Figure 12:
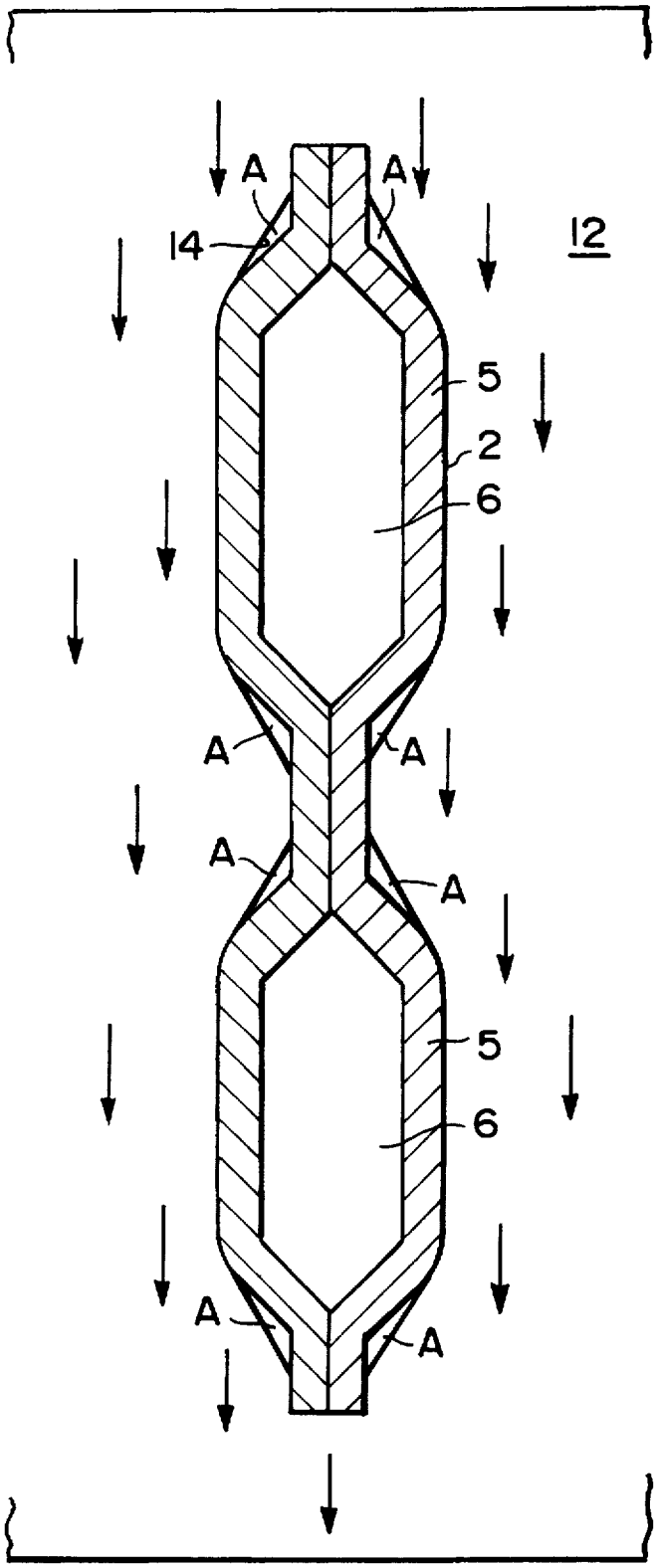
FIG. 12 PRIOR ART
FIG. 12 is an illustration which shows the flow of brazing filler material when the core of the heat exchanger in the prior art is brazed in the furnace.

The assembled heat exchanger 1 is put into the furnace and brazed by the heat brazing method. At this time, the assembled heat exchanger 1 lies sideways in the furnace 30 as shown in FIG. 11, because the height of the furnace 30 is low.

Figure 6:
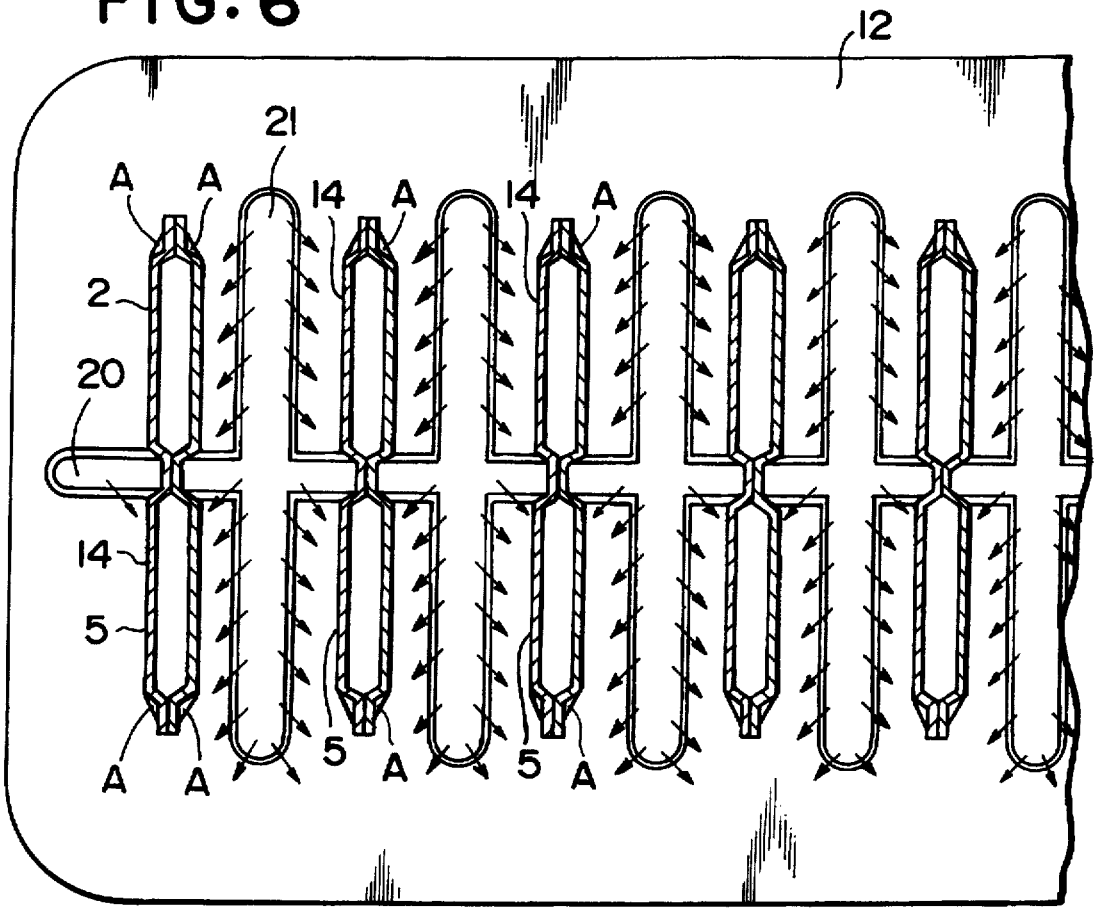
FIG. 6 is an illustration which shows the flow of brazing filler material when the core of the heat exchanger is brazed at the furnace.

Thus, the elongate direction of the insertion holes 14 is, as shown in FIG. 6, perpendicular to the horizontal, and the brazing filler material tends to flow downward. However, the brazing filler material is guided by the first and second projections 20, 21 and flows into the gaps A being between the insertion holes 14 and the connecting portions 5 of the tube elements 2.

Explaining more concretely, the brazing filler material on the second projection 21 flows along the slope of the second projection 21 into the gaps A between the insertion holes 14 and the connecting portions 5 of the tube elements 2, and the brazing filler material on the first projection 20 flows along the slope of the first projection 20 into the gaps A. The brazing filler material that has flown from the upper portions of the first projection 20 is dammed by the first projection 20 and flows in the horizontal direction along the first projection 20 and into the gaps A. Accordingly, the brazing filler material can be accurately guided to the gaps A, and thus the tube elements 2 and insertion holes 14 can be well connected.

The heat exchanger 1 may be slanted about 10 degrees to the horizontal to make it good for the brazing filler material to flow form the first and the second projections 20, 21.

The first and second projections 20, 21 projecting on the surface of the aforementioned heat exchanger are explained in that the first projection 20 and the second projection 21 mutually cross. The following shape, according to a modified form of the invention, is also possible.

Figure 7:
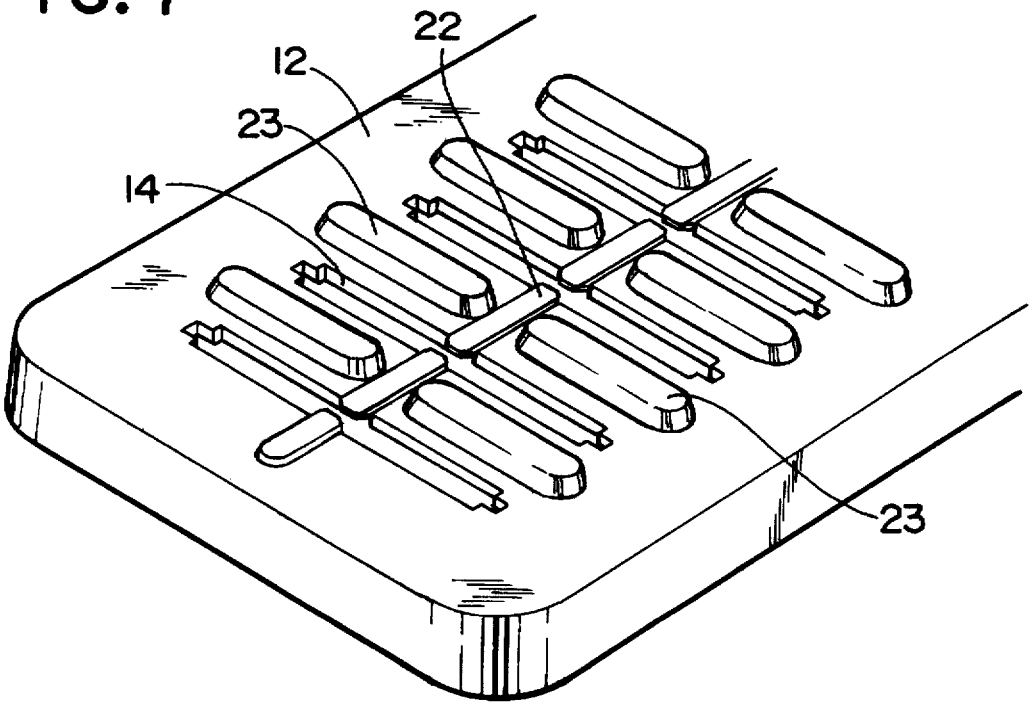
FIG. 7 is a perspective view of an end plate of a tank of a heat exchanger having a projection different from the first form of the invention.
Figure 8:
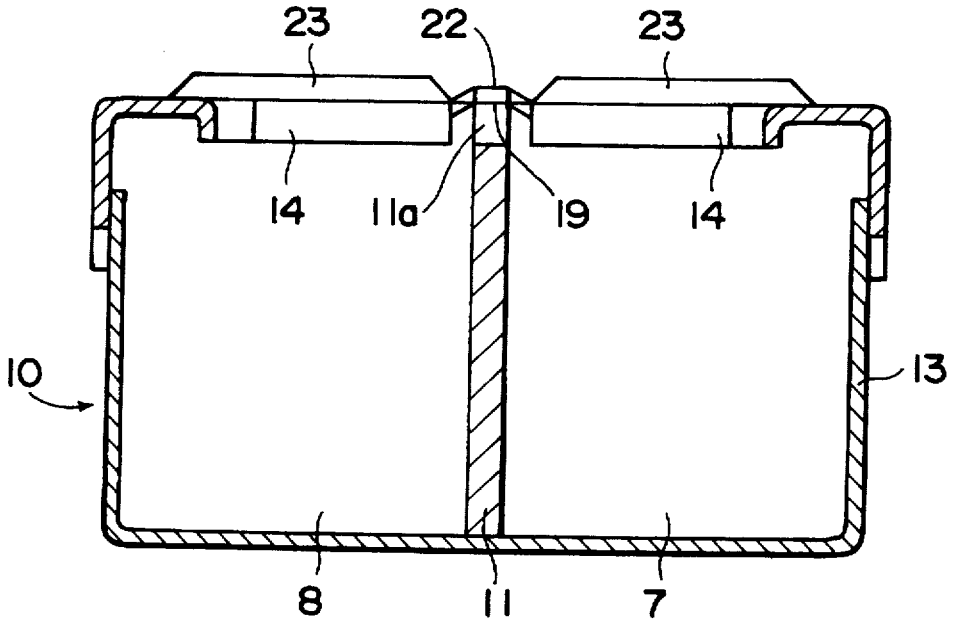
FIG. 8 is a cross-section view of the tank of the heat exchanger of FIG. 7.

That is to say, as shown in FIGS. 7 and 8, a first projection 22 is formed on the surface of the end plate 12 in the elongate direction of the end plate 12 so as to run through the narrow portion of every insertion hole 14, and second projections 23 are formed on both sides of the first projection 22. The second projections 23 are perpendicular to the first projection 22 and separate from the first projections 22. The second projections 23 extend more closely to the side edge of the end plate 12 than the insertion holes 14. Every first and second projection 22, 23 has a slope on the periphery thereof for the brazing filler material to easily flow as shown in FIG. 7. The amount that the second projection 23 is distended is larger than the amount that the first projection 20 is distended (about 0.5 mm), and is about 1.5 mm.

Figure 9:
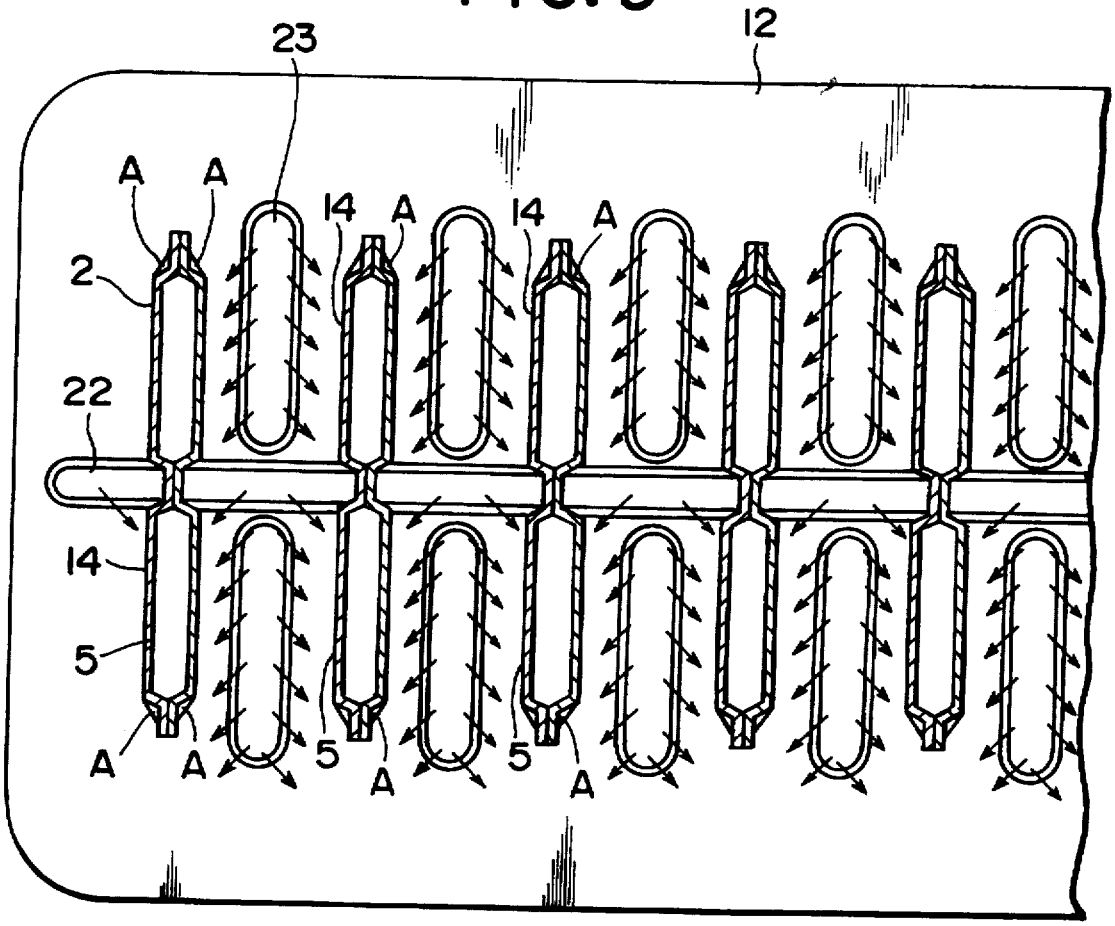
FIG. 9 is an illustration which shows the flow of brazing filler material when the core of the heat exchanger of FIG. 7 is brazed in a furnace.
Figure 10:
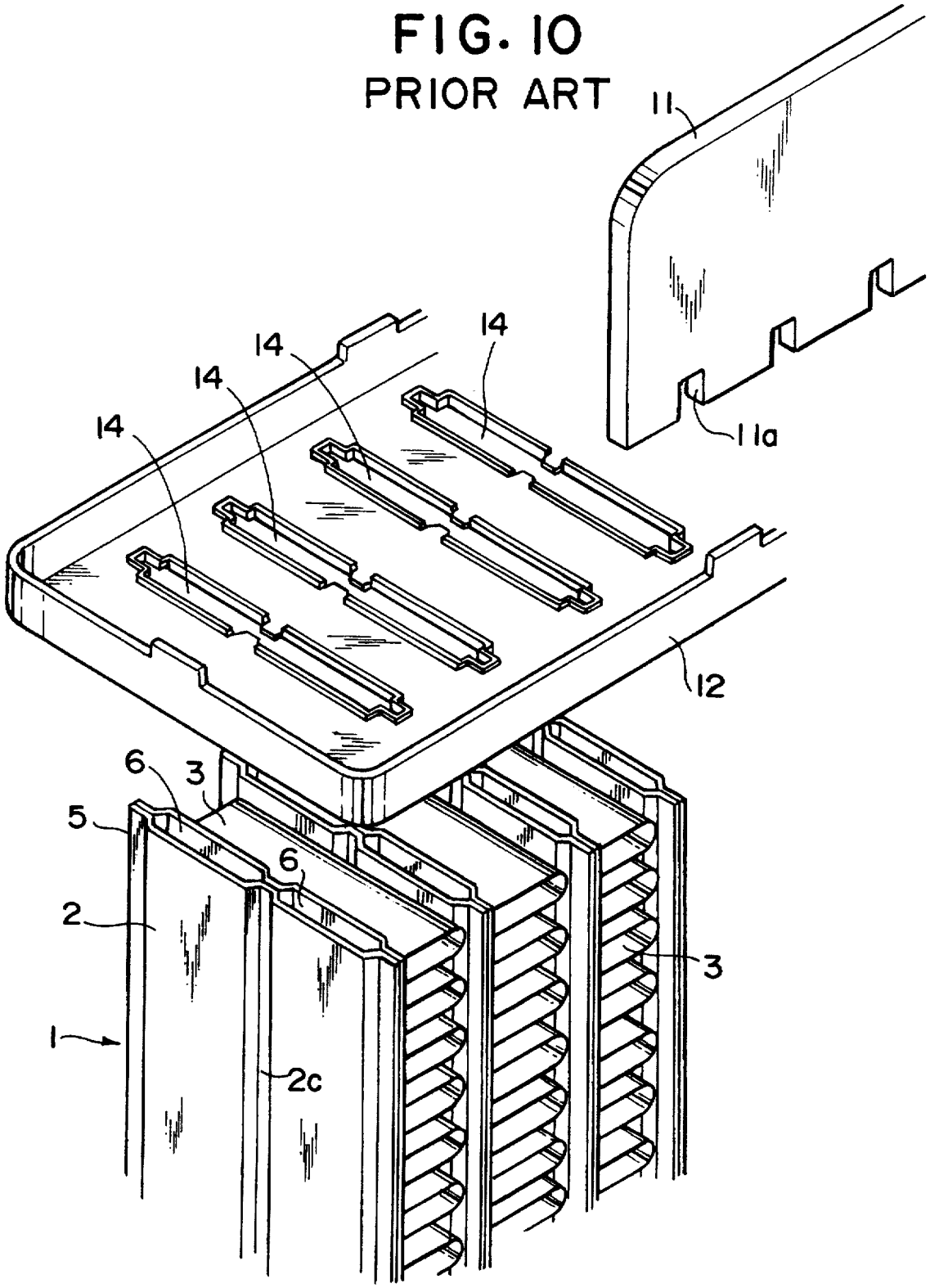
FIG. 10 PRIOR ART
FIG. 10 is an illustration which shows a part of the assembly process of a heat exchanger in the prior art.

With this constitution of the first and the second projections 22, 23, in the assembly process of the heat exchanger, when the heat exchanger is put into the furnace, as shown in FIG. 9, the brazing filler material on the second projections 23 flows along the slope thereof, into the gaps A between the insertion holes 14 and the connecting portions 5 of the tube elements 2, and the brazing filler material on the first projection 22 flows along the slope thereof into the gaps A. Downward flow of the brazing filler material positioned on the upper portion of the first projection 22 is dammed, the brazing filler material flowing along the first projection 22 in the horizontal direction into the gaps between the insertion holes 14 and the connecting portions 5 of the tube elements 2. Thus, in the same way as the former embodiment, the brazing filler material can be surely guided to the gaps A formed in the end plate 12.

The other portions of the end plate 12 in which the first and second projections 22, 23 are projected, and the constitution of the tank 10 used with the end plate 12, are similar to that of the former embodiment, and thus the explanation about them is omitted by marking them the same reference number.

As the explanation above, according to the heat exchanger of the present invention, at the time of brazing in the furnace, the brazing filler material flows to the side of the insertion holes along the second projections. A part of the brazing filler material is dammed by the first projections and flows to the side of the insertion holes along the first projection, so that the flow of the brazing filler material in the perpendicular direction can be prevented, and it can easily flow into the gaps between the insertion holes and connecting portions. As a result, brazing between the insertion holes of the tank and connecting portions of the tube elements can be good.

What is claimed is:

1. A heat exchanger, comprising;

a plurality of tube elements alternately laminated with fins in a direction of lamination, each said tube element comprising a U-shaped heat exchanging medium passage having an open end in an elongate direction of said tube element comprising intake/output openings;

a tank comprising a deep concave tank member and an end plate fitting together, said end plate having a plurality of insertion holes formed therein;

wherein said open ends of said tube elements are inserted into said plurality of insertion holes;

wherein said tank has a inside partitioned by a partition extending in the direction of lamination so as to define an intake side and an output side in said tank, said intake/output opening into said intake and output sides, respectively;

intake/output pipes connected to said deep concave tank member and communicating with said intake side and said output side, respectively;

a first projection formed in said end plate of said tank, projecting on the outside to said end plate and extending in the direction of lamination;

a second projection formed in said end plate of said tank, projecting on the outside of said end plate and positioning between adjacent said insertion holes and on opposite sides of the first projection; and a fit groove extending in the direction of lamination and formed on the other side of said first projection on the inside of said end plate, said partition being fit in said fit groove.

2. A heat exchanger according to claim 1, wherein said second projections extend perpendicularly to the direction of lamination and cross said first projection.

3. A heat exchanger according to claim 2, wherein each said second projection is longer than said insertion holes in which said tube elements are inserted.

4. A heat exchanger according to claim 2, wherein said first projection and said second projections are formed so as to distend the same amount.

5. A heat exchanger according to claim 2, wherein each of said first and said second projections has a slope along the periphery thereof.

6. A heat exchanger according to claim 1, wherein said second projections extend perpendicularly to the direction of lamination and are separate from said first projection.

7. A heat exchanger according to claim 6, wherein said second projections extend perpendicularly to the direction of lamination a greater distance than said insertion holes in which said tube elements are inserted.

8. A heat exchanger according to claim 6, wherein said second projections are formed so as to distend a greater amount than said first projection.

9. A heat exchanger according to claim 6, wherein each of said first and said second projections has a slope along the periphery thereof.

10. A heat exchanger according to claim 1, wherein said tube element comprises two formed plates bonding flush together.

11. A heat exchanger according to claim 1, wherein each said tube element is narrow along a middle portion and end portions, said insertion holes extend perpendicularly to the direction of lamination and are formed by pressing and remaining the burrs formed by the pressing, and each said insertion hole is narrow in a middle portion and at end portions so as to correspond to the form of said tube element.

12. A heat exchanger according to claim 1, wherein said tube elements are narrow in middle portions thereof, and vacant portions fitted to said middle portions of said tube elements are formed in said partition.

* * * * *